US007809318B2

(12) United States Patent
Kurosu et al.

(10) Patent No.: US 7,809,318 B2
(45) Date of Patent: Oct. 5, 2010

(54) IMAGE FORMING APPARATUS HAVING ELASTIC EXTENSION GUIDE MEMBER WITH MOVABLE PORTION

(75) Inventors: Shigetaka Kurosu, Hino (JP); Satoshi Nishida, Saitama (JP); Kazuteru Ishizuka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 50 days.

(21) Appl. No.: 11/706,472

(22) Filed: Feb. 15, 2007

(65) Prior Publication Data

US 2007/0280750 A1 Dec. 6, 2007

(30) Foreign Application Priority Data

May 31, 2006 (JP) ..... 2006-151361

(51) Int. Cl.
*G03G 15/16* (2006.01)

(52) U.S. Cl. ..... 399/316

(58) Field of Classification Search ..... 399/316, 399/388, 397
See application file for complete search history.

(56) References Cited

U.S. PATENT DOCUMENTS 4,882,606 A * 11/1989 Deguchi ..... 399/316
5,337,128 A * 8/1994 Hashizume et al. ..... 399/314
5,594,539 A * 1/1997 Murano et al. ..... 399/316
2003/0039488 A1* 2/2003 Fayette et al. ..... 399/316
2005/0069343 A1* 3/2005 Deguchi et al. ..... 399/111
2006/0216075 A1* 9/2006 Sugawara et al. ..... 399/316
2007/0258738 A1* 11/2007 Begeal et al. ..... 399/316

FOREIGN PATENT DOCUMENTS

| | | |
|---|---|---|
| JP | 62-49170 | 3/1987 |
| JP | 63-43136 | 2/1988 |
| JP | 4-107051 | 9/1992 |
| JP | 8-76607 | 3/1996 |
| JP | 10-123849 A | 5/1998 |
| JP | 11-139619 A | 5/1999 |

OTHER PUBLICATIONS

Japanese Office Action for Patent Application No. 2006-151361 mailed Jun. 15, 2010 with English translation.

* cited by examiner

*Primary Examiner*—David M Gray
*Assistant Examiner*—Billy J Lactaoen
(74) *Attorney, Agent, or Firm*—Cantor Colburn LLP

(57) ABSTRACT

An image forming apparatus which forms a toner image on a transfer material, including: an image carrier which carries a toner image; a transfer section which transfers the toner images carried on the image carrier onto a transfer material; and a guide section having paired guide surfaces whose guide surfaces guide the transfer material to a transfer position of the transfer section while supporting the transfer material in between; wherein an end of one of the paired guide surfaces, which is closer to the image carrier than another one of the paired guide surfaces, has an elastic extension guide member, and a tear resistance of an leading portion of the elastic extension guide member is greater than the tear resistance of other portions of the elastic extension guide member.

6 Claims, 4 Drawing Sheets

IMAGE FORMING APPARATUS HAVING ELASTIC EXTENSION GUIDE MEMBER WITH MOVABLE PORTION

This application is based on Japanese Patent Application No. JP2006-151361 filed on May 31, 2006, with the Japanese Patent Office, the entire content of which is hereby incorporated by reference.

BACKGROUND OF THE INVENTION

The present invention relates to an image forming apparatus, such as an image forming apparatus using an electrophotographic method.

In an electro-photographic image forming apparatus, after images are formed on an image carrier, such as a photoconductor and an intermediate transfer body, the images are then transferred and formed as a permanent image on a transfer material, such as paper. When the speed of image formation is increased, or the image forming apparatus is downsized, the quality of the formed images tends to become degraded, because the images are distorted due to the vibration generated on a trailing edge of the transfer material due to high speed conveyance, which becomes a major problem.

Patent Documents 1 and 2 point out the above problem, and propose countermeasures.

That is, Patent Document 1 proposes a guide plate which softly presses a sheet of transfer material against the guide section to guide the transfer material to a transfer position.

Patent Document 2 proposes that an elastic guide member is assembled on an end of paired guide plates which guide the transfer material to the image transfer position, and that a free end of the guide member is folded at a predetermined angle.

[Patent Document 1] Unexamined Japanese Patent Application Publication No. 61-188,345

[Patent Document 2] Unexamined Japanese Patent ApplicationPublication No. 8-76,607

Degradation of the images due to the vibration of the trailing edge of the transfer material will now be detailed while referring to FIG. 1, which shows examples of the image degradation, as well as FIG. 4 which shows the transfer section of the image forming apparatus relating to the present embodiment.

In FIG. 4, transfer material P is conveyed by registration roller 23 to transfer position TR, which conducts a secondary transfer, and is structured of transfer section 7A and electrically grounded roller 61, whereby the toner images are transferred from intermediate transfer body 6 as permanent images onto transfer material P.

Paired guide plates 30 and 31, as rigid metal, guide transfer material P between registration roller 23 and transfer position TR.

When the trailing edge of transfer material P separates from upper guide plate 31, it tends to spring and vibrate so that toner dust particles are loosened, and misaligned image transfer occurs. The toner dust particles produce small points of toner on non-image area, as shown in FIG. 1(*a*), while the misaligned image transfer means slippage of the transferred image, as shown in FIG. 1(*b*). Such phenomena happen due to the high rigidity of thick transfer material P. In order to counter the phenomena, elastic extension guide member 32 is mounted on the end of upper guide plate 31, which decreases spring-up of the trailing edge of transfer material P, whereby the toner dust particles and the misaligned image transfer are effectively controlled.

The vibration control effects conducted by the elastic guide member are used in Patent Documents 1 and 2, the technologies of which can prevent degradation of the images on some level, however further problems as described below have occurred.

In recent years, high performance image forming apparatus, such as a color image forming apparatus, has been produced, and which has been used in various areas to produce various kinds of documents as well as documents for office use, and the types of the transfer materials have widely expanded. Further, due to the increased speed of the image formation, extension guide member 32 is strongly shocked by spring-up of the trailing edge of the transfer material, and extension guide member 32 tends to become damaged.

FIGS. 2(*a*) and 2(*b*) show examples of damaged extension guide member 32.

Extension guide member 32 is damaged when the trailing edge of the transfer material hits leading portion 32A of extension guide member 32, resulting for instance, as flipped end DF1 shown in FIG. 2(*a*), or cut edge DF2 shown in FIG. 2(*b*).

Due to the damage, extension guide member 32 can not exercise its guiding function well, which causes toner dust particles and misaligned image transfer, and also causes jamming of the transfer materials. Further, cut edge DF2 allows extension guide member 32 to bend easily. Bent extension guide member 32 abnormally approach the image carrier, and allows the image carrier to trigger an electrical discharge, which further results in distorted images.

Once the durability of extension guide member 32 is deteriorated, it is very difficult to stably produce high quality images for a long time, which of course becomes a major problem.

To solve this problem, the strength of extension guide member 32 can be increased, extension guide member 32 reduces control of the vibration of the transfer material, resulting in the generation of the toner dust particles and the misaligned image transfer.

SUMMARY OF THE INVENTION

An object of the present invention is to solve the above problems about the image degradation on the image transfer section.

The above objects will be attained by a structure described below.

An image forming apparatus which forms a toner image on a transfer material, including: an image carrier which carries a toner image; a transfer section which transfers the toner images carried on the image carrier to a transfer material; and a guide section having paired guide surfaces which guide the transfer material to a transfer position of the transfer section while supporting the transfer material in between; wherein an end of one of the paired guide surfaces, which is closer to the image carrier than another one of the paired guide surfaces, has an elastic extension guide member, and a tear resistance of an leading portion of the elastic extension guide member is greater than the tear resistance of other portions of the elastic extension guide member.

DETAILED DESCRIPTION OF THE PREFERRED EMBODIMENT

The present invention will now be detailed based on the embodiments of the present invention, however the present invention is not limited to these embodiments. In this specification, "end" of the guide plate represents the "downstream side with respect to the conveyance direction of the transfer material" between the guide plates, while "end" of the guide member represents the "downstream side of the guide member with respect to the same" on the guide member.

Figure 1:
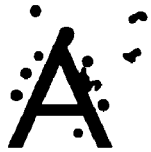
FIGS. 1(*a*)-1(*b*) show examples of damaged formed images.
Figure 1:
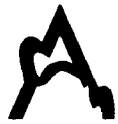
Figure 2:
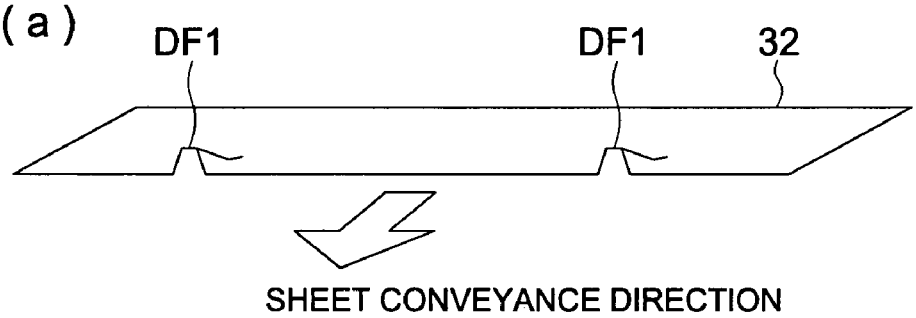
FIGS. 2(*a*)-2(*b*) show examples of damaged guide member.
Figure 2:
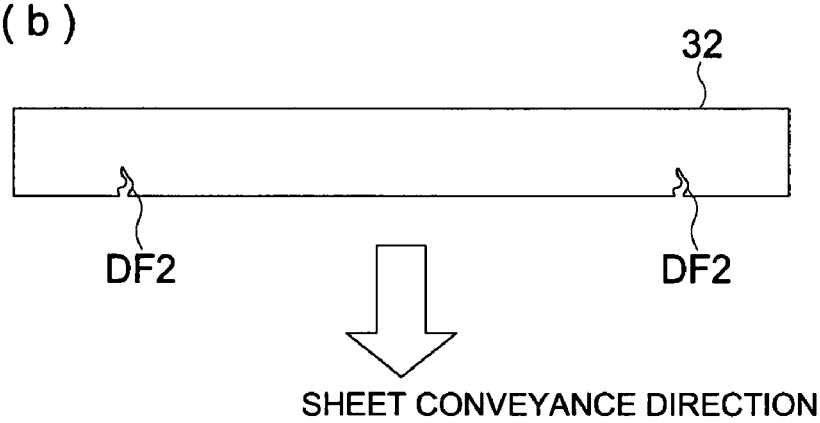
Figure 3:
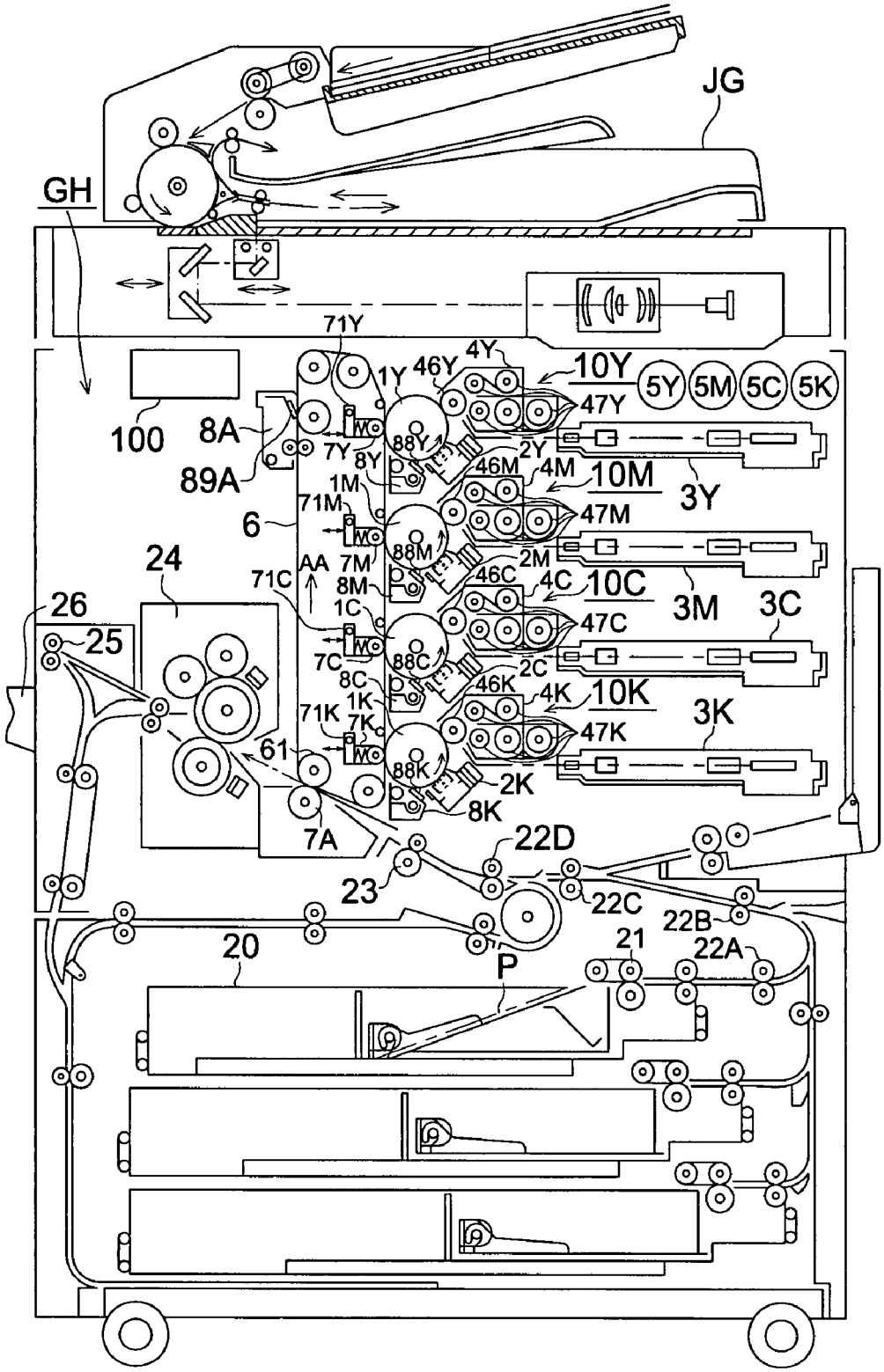
FIG. 3 shows the total structure of the image forming apparatus which relates to the embodiments of the present invention.

FIG. 3 shows the total structure of the image forming apparatus which relates to the embodiments of the present invention.

The image forming apparatus shown in FIG. 3 is a color image forming apparatus to form full color images, and which is structured of image forming main body GH and automatic document feeding apparatus JG which is mounted on the same main body GH.

Image forming main body GH, which is a so called tandem type full-color image forming apparatus, includes image forming sections 10Y, 10M, 10C and 10K, control section 100, belt shaped intermediate transfer body 6, a sheet supplying section, fixing section 24, and operation section 9 which is not illustrated, wherein image forming sections 10Y, 10M, 10C and 10K are mounted in parallel, to face belt shaped intermediate transfer body 6 which rotates in arrowed direction AA.

Image forming section 10Y which forms yellow images includes charging section 2Y, exposure section 3Y, developing section 4Y and cleaning section 8Y, all of which are mounted around photoconductor 1Y which serves as an image carrier.

Image forming section 10M which forms magenta images includes, in the same way as the former, photoconductor 1M, charging section 2M, exposure section 3M, developing section 4M and cleaning section 8M.

Image forming section 10C which forms cyan images includes, in the same way as the former, photoconductor 1C, charging section 2C, exposure section 3C, developing section 4C and cleaning section 8C.

Image forming section 10K which forms black images includes, in the same way as the former, photoconductor 1K, charging section 2K, exposure section 3K, developing section 4K and cleaning section 8K.

An electrostatic latent image forming section for each color is structured of charging section 2Y and developing section 3Y, charging section 2M and developing section 3M, charging section 2C and developing section 3C, and charging section 2K and developing section 3K.

Toner storage containers 5Y, 5M, 5C and 5K store yellow toner, magenta toner, cyan toner and black toner, respectively.

Toner is supplied to developing sections 4Y, 4M, 4C and 4K from toner storage containers 5Y, 5M, 5C and 5K, respectively, based on consumed amounts.

Photoconductors 1Y, 1M, 1C and 1K are negative OPC photoconductors, metallic drums of which are formed of an OPC photosensitive layer. In addition, other than OPC photoconductor, such as "aSi photoconductor", can be used for photoconductors 1Y, 1M, 1C and 1K. Further, a positive photoconductor can also be used. Encoders, which are not illustrated, are provided on photoconductors 1Y, 1M, 1C and 1K respectively so that the encoders output signal by one rotation of the photoconductors. Control section 100 counts the outputted signals to obtain the number of rotations of photoconductors 1Y, 1M, 1C.

Corotron discharger and scorotron discharger can be used for charging sections 2Y, 2M, 2C and 2K, for which a discharging wire and a saw-tooth electrode can be used.

Exposure section 3Y, which incorporates a semiconductor laser as a light source, exposes photoconductor 1Y with an intermittent laser beam generated by the light source, based on the yellow image data. In the same way, exposure section 3M exposes photoconductor 1M, based on the magenta image data, exposure section 3C exposes photoconductor 1C, based on the cyan image data, and exposure section 3K exposes photoconductor 1K, based on the black image data. Exposure sections 3Y, 3M, 3C and 3K can use an exposure means other than the laser beam, such as an LED array, and a liquid crystal, however, an intermittent light beam is preferable.

In a forced consumption mode which forces the developing section to consume toner, in order to forcibly consume each colored toner in developing sections 4Y, 4M, 4C and 4K, exposure sections 3Y, 3M, 3C and 3K expose predetermined patterns on photoconductor 1Y, 1M, 1C and 1K, based on the signals outputted from control section 100, which will be further detailed later.

Developing sections 4Y, 4M, 4C and 4K incorporate open sections which face photoconductor 1Y, 1M, 1C and 1K, and convey developers, during rotation of cylindrical developer carrying sections 46Y, 46M, 46C and 46K, to agitate the respective color developers. Agitation screws 47Y, 47M, 47C and 47K supply the agitated developer to developer carrying sections 46Y, 46M, 46C and 46K. Toner supplied from toner storage container 5Y, 5M, 5C and 5K are supplied to developer carrying sections 46Y, 46M, 46C and 46K, while being agitated by agitation screws 47Y, 47M, 47C and 47K.

As the developer, a dual component developer including a toner and a carrier can be used, or a single component developer including only toner can be used.

As developing sections 4Y, 4M, 4C and 4K, either a reversal developing method in which toner is attached to the exposure section, or a normal developing method in which toner is attached to the non-exposed section, can be used. Further, either a contact developing method or a non-contact developing method can be used. Accordingly, any well-known developing means can be used for developing sections 4Y, 4M, 4C and 4K, but the reversal developing method of a dual component developer is more preferable.

First cleaning sections 8Y, 8M, 8C and 8K include rubber cleaning blades 88Y, 88M, 88C and 88K as first cleaning members, which are arranged along the whole length of cylindrical photoconductors 1Y, 1M, 1C and 1K, aligned along their axial direction, respectively. Edge portions of cleaning blades 88Y, 88M, 88C and 88K come into contact with the surfaces of photoconductors 1Y, 1M, 1C and 1K, and when photoconductors 1Y, 1M, 1C and 1K rotate, the edge portions wipe the surfaces of photoconductors 1Y, 1M, 1C and 1K, whereby remaining toner is removed.

Intermediate transfer body 6 as the image carrier is an endless belt which is made of a semiconductor at an electrical resistance of $10^5\Omega$-$10^{10}\Omega$, which are entrained about various rollers including grounded roller 61, and to rotate based on outputted signals from control section 100 to a driving section, which is not illustrated, of intermediate transfer body 6.

While primary transfer sections 7Y, 7M, 7C and 7K are pressed onto rotating intermediate transfer body 6, primary transfer output which has opposite polarity to the toner is applied to primary transfer sections 7Y, 7M, 7C and 7K, to form an electrical transfer field. Accordingly, each color image formed by image forming section 10Y, 10M, 10C and 10K are primarily transferred on intermediate transfer body 6, which result in superposed color image.

When image formation is not performed, primary transfer sections 7Y, 7M, 7C and 7K are ordinarily allowed to be separated from intermediate transfer body 6 by contact-separation sections 71Y, 71M, 71C and 71K. Just before the toner having formed image arrives at the intermediate transfer position, primary transfer sections 7Y, 7M, 7C and 7K are allowed to come into contact with intermediate transfer body 6 by contact-separation sections 71Y, 71M, 71C and 71K. Contact with or separation from intermediate transfer body 6 is controlled by control section 100 via contact-separation sections 71Y, 71M, 71C and 71K.

A power supply section, which is not illustrated, applies primary transfer output signals to primary transfer sections 71Y, 71M, 71C and 71K. The methods of the above applying control are (1) a constant electrical current control method: wherein the predetermined target current value is established, and the transfer electrical current is controlled to be the predetermined target current value, and (2) a constant electrical voltage control method: wherein the electrical voltage value is established, and the transfer voltage is controlled to be the predetermined target voltage. In the case of (1), electrical current value becomes the primary transfer output signals, while in the case of (2), electrical voltage value becomes the primary transfer output signals. In the present embodiment, to output the primary output signals, the electrical current value, that is, constant electrical current control method (1) is used. Control section 100 controls the primary transfer output, which is the electrical current value, and timing, to be applied to primary transfer sections 71Y, 71M, 71C and 71K, based on the primary transfer output applying section. In the usual image formation, in order to achieve a transfer ratio of approximately 100%, the first transfer output is set to be 30 μA.

For the primary transfer section, a semi-conductive type roller of a resistance of $10^5\Omega$-$10^{10}\Omega$ is used.

After colored toner has been primarily transferred on intermediate transfer body 6, any remaining colored toner on the surfaces of photoconductors 1Y, 1M, 1C and 1K is cleaned by cleaning blades 88Y, 88M, 88C and 88K which are first cleaning members. Further, in the forced consumption mode, any toner which was forcibly consumed is also cleaned, which will be detailed later.

Transfer material P, accommodated in sheet supplying cassette 20 of a sheet conveyance section, is supplied by sheet supplying section 21, and is conveyed to secondary transfer section 7A via paired rollers 22A, 22B, 22C, 22D and registration roller 23, after which the color image is secondarily transferred onto transfer material P. Transfer material P carrying the transferred color image is fixed by fixing section 24, after which it is conveyed by paired ejecting rollers 25 to sheet tray 26 which is mounted on the extension of the apparatus in FIG. 3.

After secondary transfer section 7A transfers the color images onto transfer material P, second cleaning section 8A cleans intermediate transfer body 6, from which transfer material P has separated, using rubber cleaning blade 89A.

Figure 4:
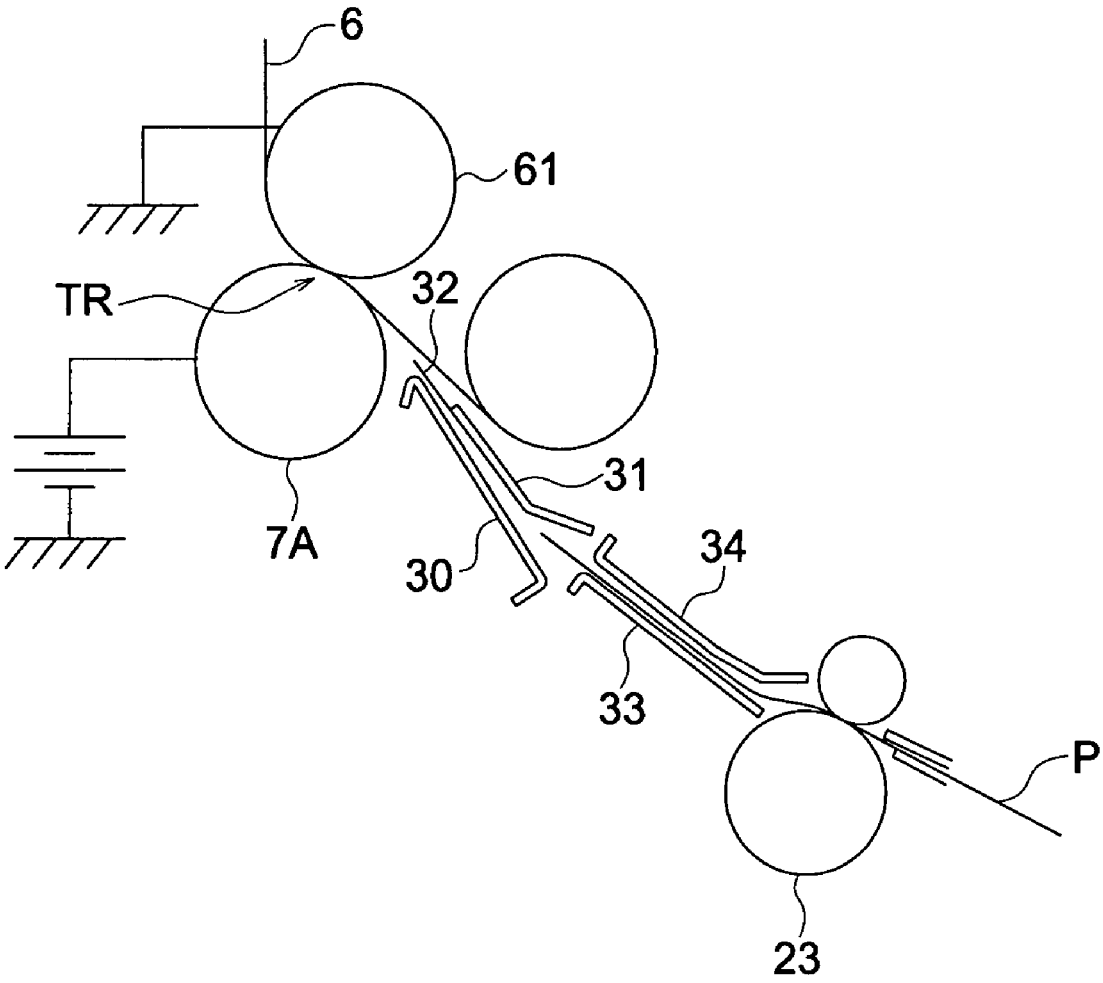
FIG. 4 shows an enlargement of the secondary transfer section of the image forming apparatus shown in FIG. 3.

FIG. 4 shows an enlargement of the secondary transfer section of the image forming apparatus shown in FIG. 3.

Transfer material P is conveyed by registration roller 23, which is the transfer means, to transfer position TR which is structured of grounded roller 61 and secondary transfer section 7A which is a roller carrying the transfer voltage.

Paired guide plates 30 and 31, which are formed of rigid metallic plates, form the conveyance path between registration roller 23 and transfer section TR. Paired guide plates 33 and 34 are also formed of rigid metallic plates, and are mounted upstream of paired extension guide plates 30 and 31.

Extension guide member 32, which is elastic, is mounted on a downstream side of upper guide plate 31, which is closer to intermediate transfer body 6 than lower guide plate 30 is to, serves as an end guide surface. Extension guide member 32 is made of an elastic plate, such as PE (polyethylene resin) and PET (polyethylene terephthalate resin), or a type of rubber. That is, the base of extension guide member 32 is adhered onto upper guide plate 31. To prevent generation of friction-charged electrostatic potential, a sheet, which is formed to have electrical conducting properties, is used for extension guide member 32.

Upper guide plate 31 and extension guide member 32 structure an upper guide section which is between registration roller 23 and transfer position TR, and is closer to intermediate transfer body 6 than lower guide plate 30 is to. Lower guide plate 30 structures a lower guide section which faces upper guide plate 31 and extension guide member 32.

Elastic extension guide member 32 prevents the generation of toner dust particles or misaligned image transfer, and even when thick paper, such as coated paper, is used for transfer material P, elastic extension guide member 32 effectively prevents the generation of toner dust particles or misaligned image transfer, and images formed on said thick paper exhibit high quality.

However, when a very high rigid transfer material P is used, the trailing edge of such high rigid transfer material P strongly hits an leading portion of elastic extension guide member 32, and the leading portion is curled or cut, which results in a lower operational life. In the present invention, since the tear resistance of functional leading portion 32A of extension guide member 32 is heightened, extension guide member 32 can have a long operational life, and can prevent the trailing edge of transfer material P from swishing.

Figure 5:
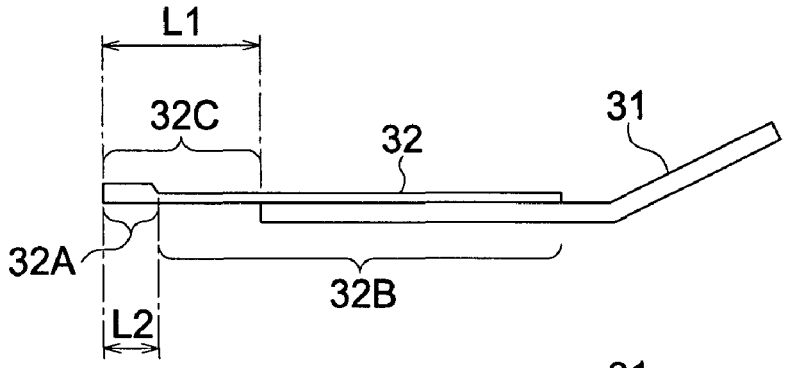
FIGS. 5(*a*)-5(*f*) show examples of elastic extension guide member 32 which is prevented from being damaged by the trailing edge of transfer material P.
Figure 5:
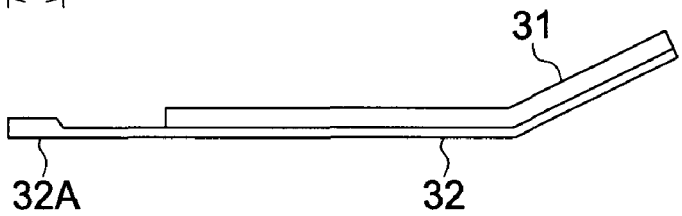
Figure 5:
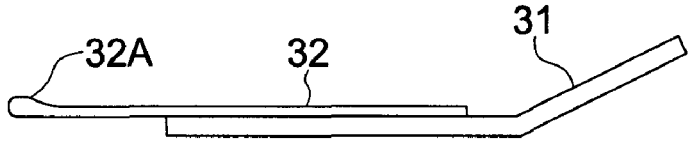
Figure 5:
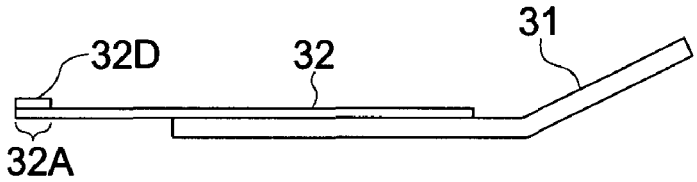
Figure 5:
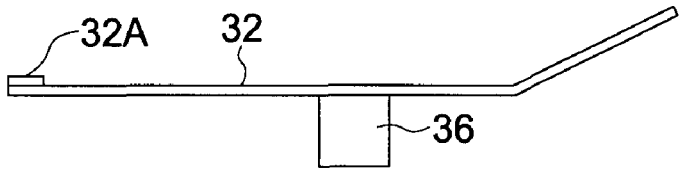
Figure 5:
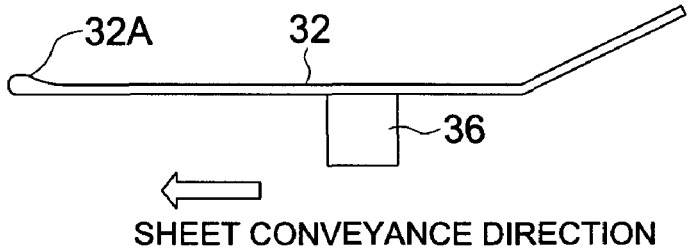

FIGS. 5(*a*)-5(*f*) show several examples of extension guide member 32 which is prevented from being damaged by the trailing edge of transfer material P.

FIG. 5(*a*) shows a basic form of extension guide member 32, in which the thickness of functional leading portion 32A of extension guide member 32 is increased so that the tear resistance of functional leading portion 32A increases, and functional leading portion 32A is formed by molding process. The tear resistance is further detailed in JIS K6301.

The base of extension guide member 32 is mounted on the downstream end of upper guide plate 31, which is rigid. Movable portion 32C, which projects from guide plate 31, tends to be bent by the trailing edge of transfer material P, which tends to prevent the trailing edge from springing up. Functional leading portion 32A is thicker than portion 32B which is other than functional leading portion 32A, and has strong tear resistance. Due to the above structure of extension guide member 32, extension guide member 32 can maintain an anti-swishing function against the trailing edge of transfer material P, and prevents damage to functional leading portion 32A.

Length L1 of movable portion 32C, which projects from upper guide plate 31, is preferably 4-6 mm, while length L2 of functional leading portion 32A is preferably 1-2 mm. Under the condition that PE is used for extension guide member 32, the thickness of only portion 32B is 100 μm, and that the thickness of functional leading portion 32A is 250 μm, functional leading portion 32A of extension guide member 32 is not damaged, and thereby secondary image transfer is excellently conducted.

FIG. 5(*a*) shows extension guide member 32 which is adhered to a surface of upper guide plate 31, while FIG. 5(*b*) shows extension guide member 32 which is adhered to the reverse surface of upper guide plate 31.

FIG. 5(*c*) shows extension guide member 32, which is an elastic sheet, and a thick end of functional leading portion 32A is formed by heat treatment. For example, an end of a resin sheet is pressed against a heating device, so that the end of functional leading portion 32A is melted to increase its thickness.

FIG. 5(*d*) shows extension guide member 32, of which functional leading portion 32A is formed of a doubled film sheet of the same material as the sheet used for extension guide member 32.

In FIG. 5(*d*), for the small sheet adhered on functional leading portion 32A of extension guide member 32, a sheet can also be used which exhibits a higher tear resistance than that of extension guide member 32. For example, extension guide member 32 is formed of PE at a thickness of 100 μm, and a reinforcement member, which is PET at a thickness of 100 μm, is adhered on functional leading portion 32A of extension guide member 32, whereby functional leading portion 32A of extension guide member 32 is reinforced.

FIGS. 5(*e*) and 5(*f*) show how the upper guide plate 31, being closer to the image carrier, of a pair of guide plates which guide transfer sheet P from registration roller 23 to transfer position TR, is totally structured of elastic extension guide member 32.

Since the upper guide plate 31 in this case is totally elastic, leading portion 32A of extension guide member 32 is also elastic, wherein supporting members 36 are mounted on both sides of the conveyance path, and they are adhered to extension guide member 32 to support, but only one of supporting members 36 is shown in FIGS. 5(*e*) and 5(*f*). Accordingly, elastic extension guide member 32 changes whole form of itself to control any swish of the trailing edge of transfer material P.

Additionally, two elastic sheets are superposed to enforce leading portion 32A, of extension guide member 32 shown in FIG. 5(*e*), while leading portion 32A is formed to be thicker to be enforced as shown in FIG. 5(*f*).

EXPERIMENTAL RESULT

The inventor performed laboratory experiments of image formation under the condition that the conveyance speed of transfer material P is 220 mm/sec, the basic weight of transfer material P is 300 gsm, and the size of transfer material P is A4 (cross-conveyance). In the case that leading portion 32A of extension guide member 32, formed of non-enforced PE at a thickness of 100 μm, was used, after the images were formed on 20,000 sheets, leading portion 32A of extension guide member 32 showed deformation, and after the image formation on 50,000 sheets, discontinuity occurred on leading portion 32A.

Further, when leading portion 32A, of extension guide member 32 formed of enforced PE at a thickness of 100 μm, was used, after image formations on 50,000 sheets, no deformation, no discontinuity nor curling occurred.

Based on the present invention, because the tear resistance is heightened at the end of the elastic guide member provided on the end portion of the guide section which guides the transfer material to the transfer position, the guide member does not reduce control of the vibration of the transfer material, and further, the durability of the guide member increases, resulting in the generation of the images of high quality.

What is claimed is:

1. An image forming apparatus which forms a toner image on a transfer material, comprising:

an image carrier which carries a toner image;

a transfer section which transfers the toner images carried on the image carrier onto a transfer material; and a guide section having paired guide surfaces which guide the transfer material to a transfer position of the transfer section while supporting the transfer material in between;

wherein an end of one of the paired guide surfaces, which is closer to the image carrier than another one of the paired guide surfaces, has an elastic extension guide member and a tear resistance of a leading portion of the elastic extension guide member is greater than the tear resistance of other portions of the elastic extension guide member, wherein the leading portion of the elastic extension guide member is formed by a heat treatment.

2. The image forming apparatus of claim 1, wherein a thickness of the leading portion of the elastic extension guide member is greater than the thickness of other portion of the elastic extension guide member.

3. The image forming apparatus of claim 1, wherein a reinforcement member is adhered on the leading portion of the elastic extension guide member.

4. The image forming apparatus of claim 3, wherein the tear resistance of the reinforcement member is greater than the tear resistance of the elastic extension guide member.

5. The image forming apparatus of claim 1, wherein the guide section comprises rigid guide plates, and a base of the elastic extension guide member is mounted on the end of the rigid guide plates.

6. The image forming apparatus of claim 1, further comprising a conveyance path through which the transfer material is conveyed to the guide section, and the elastic extension guide member is supported by a supporting member which is mounted on a side of the conveyance path.

* * * * *